United States Patent [19]

Cornell

[11] 3,942,976

[45] Mar. 9, 1976

[54] METAL RECOVERY PROCESS

[75] Inventor: Frank M. Cornell, Monterey Park, Calif.

[73] Assignee: Neo-Pro Corporation, Los Angeles, Calif.

[22] Filed: June 28, 1973

[21] Appl. No.: 374,330

Related U.S. Application Data

[63] Continuation of Ser. No. 119,285, Feb. 26, 1971, abandoned.

[52] U.S. Cl. ..... 75/23; 75/27

[51] Int. Cl. ..... C21b 15/02

[58] Field of Search ..... 75/.5, 23, 5, 27, 21, 1, 75/3, 4; 209/223

[56] References Cited

UNITED STATES PATENTS

| | | | |
|---|---|---|---|
| 228,329 | 6/1880 | Edison | 209/223 |
| 1,321,684 | 11/1919 | Turner | 75/27 |
| 2,370,610 | 2/1945 | Adeline | 75/27 |
| 2,784,073 | 3/1957 | Michalke | 75/.5 |
| 2,789,896 | 4/1967 | Coffer | 75/27 |
| 3,528,081 | 9/1970 | Huseby | 75/.5 BA |

*Primary Examiner*—P. D. Rosenberg

*Attorney, Agent, or Firm*—Lyon & Lyon

[57] ABSTRACT

A process is disclosed for recovering metals from sulfide or oxide containing ores or mixtures or concentrates thereof in which a mass of ore and metallic aluminum is ignited and sintered at a temperature within the range of approximately 1000° to about 1500° Centigrade. The metals are thereafter separated and recovered.

17 Claims, 1 Drawing Figure

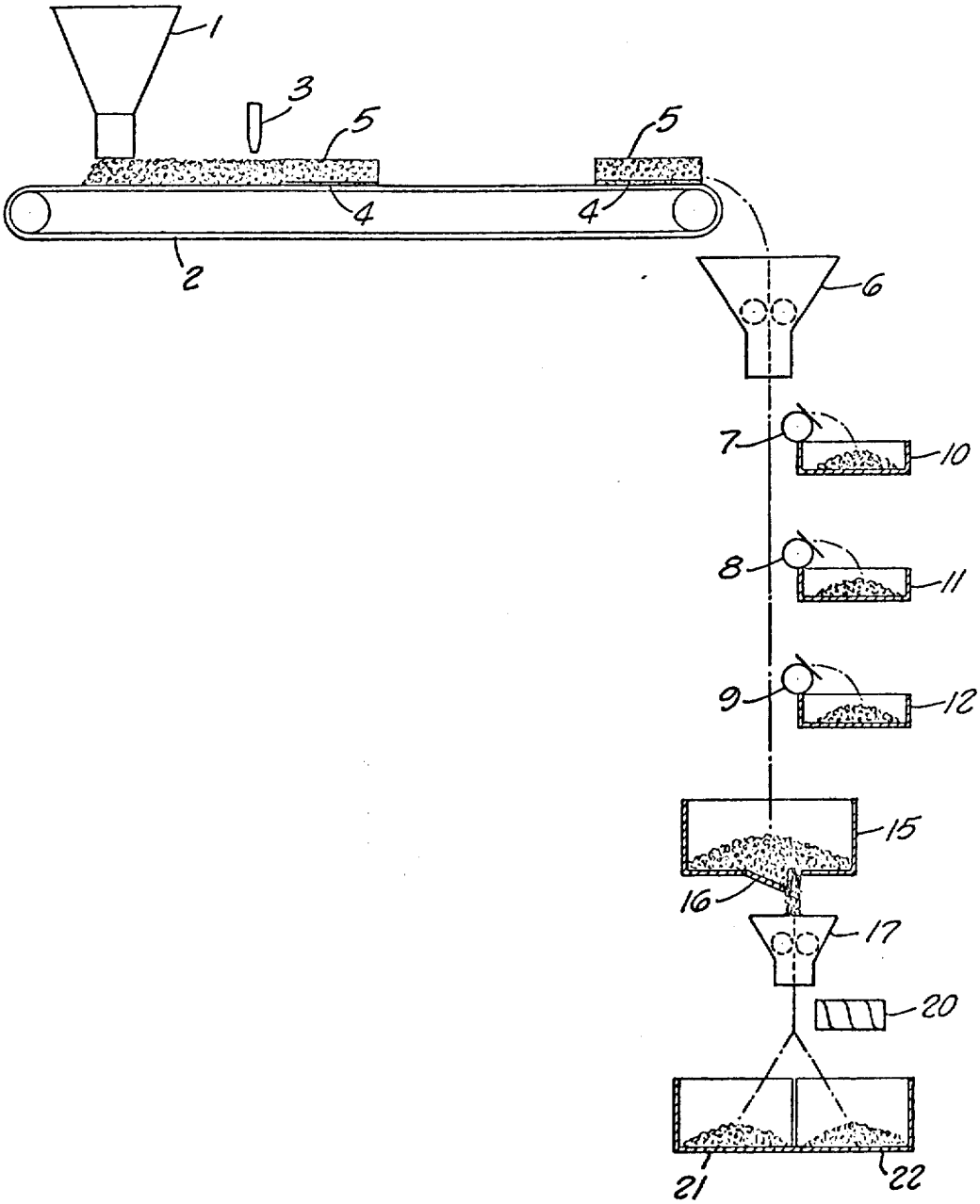
1
3
5
5
4
4
2
6
7
10
8
11
9
12
15
16
17
20
21
22

METAL RECOVERY PROCESS

This application is a continuation of Ser. No. 119,285, filed Feb. 26, 1971 and now abandoned.

BACKGROUND OF INVENTION

The present invention relates to the recovery of the metal content of oxide or sulfide containing ores such as pyrite ores. As is well known, pyrite, pyrrhotite and related type ores contain many valuable metals, including arsenic, nickel, cobalt, copper and gold in addition to iron. Although these metals are quite valuable, it is difficult to separate and recover such metals efficiently and effectively for several reasons. First, many such ores, especially the pyrites, contain large sulfur content, which requires carefully controlled processing for removal and disposition. This is particularly significant at the present time due to the widespread interest in avoiding or minimizing atmospheric pollution.

Also, with many ores, the metals are intimately associated with silica, which makes separation and recovery difficult and expensive, particularly with metals such as iron, nickel and cobalt which readily combine with silica to form the respective silicates. Moreover, in either sintering or smelting processes, which have customarily been used to separate the metal contents, high temperatures are normally required with ores having a significant silica content, which poses highly significant problems in the selection of suitable equipment capable of maintaining high temperatures for extended periods of time.

In processes previously used, it has been common practice to utilize carbonaceous reducing agents to achieve separation of metals such as iron, nickel or cobalt. The carbonaceous reducing agents are normally intimately admixed with the ore, after which the admixture is roasted at temperatures substantially higher than 1500° Centigrade to reduce the metal oxides and sulfides to the metal state. The use of carbonaceous reducing agents suffers from the disadvantage that significant quantities of the reducing agents are lost during ignition. It is also necessary to control carefully the furnace atmosphere during roasting to achieve metallization. By the same token, an elaborate heating system is generally required to produce and maintain the high temperature which is necessary during roasting.

SUMMARY OF INVENTION

It is accordingly a principal object of the present invention to provide a process enabling effective separation and recovery of metals from sulfide or oxide containing ores by which the aforementioned problems of previously used processes are overcome.

Another principal object of this invention is to provide a process for the separation and recovery of metals from sulfide or oxide containing ores without the use of carbonaceous reducing agents and without the use of a smelting furnace or other elaborate high temperature furnace.

Yet another object of this invention is to provide a metal recovery process which may be practiced utilizing relatively simple equipment which may be readily and easily ported for use at different mine locations.

In one form, the process includes the ignition of an admixture of a sulfide or oxide containing ore and metallic aluminum, followed by sintering at a temperature within the range of from about 1000° to about 1500° Centigrade. As is explained in more detail hereinafter, the metal content can subsequently be separated and recovered.

DESCRIPTION OF PREFERRED EMBODIMENTS

The present invention can be used to refine or beneficiate various types of sulfide or oxide containing ores, as well as mixtures and concentrates thereof. This invention has been found to be especially suitable for use with pyrite and pyrite type ores which contain many extremely valuable metals. This invention can also be used to refine ores such as pyrrhotites, galena, chalcopyrite, decomposed pyrite ores, arsenoc pyrites, and other ores which are capable of reacting with metallic aluminum. In processing decomposed pyrite ores, that is clay type ores which have been subjected to extreme conditions of weather, it may be necessary to add sulfur to the ore prior to ignition in order to process the ore at the indicated temperatures, as sulfur will facilitate the reduction reaction.

The ore is intimately admixed with metallic aluminum, which may be scrap aluminum or metallic aluminum derived from substantially any source. Preferably, the mixture of ore and aluminum is ground to −200 mesh (U.S. Standard Sieve Series) or finer and utilized in powder form so that more uniform ignition is achieved. The mixture can, however, be formed into compacts such as pellets or briquettes, if desired. To reduce the ore and metal aluminum to the appropriate particle size, each may be ground separately or the two components may be ground together in any suitable standard grinding apparatus.

After the appropriate admixture of ore and metallic aluminum has been achieved, the admixture is ignited, which may be carried out in various ways. One effective manner of performing the present invention is shown in the accompanying drawing which illustrates schematically one form of the present process. The admixture of ore and metallic aluminum thus is deposited from hopper 1 onto belt conveyor 2. The deposit of the admixture is normally approximately 1 inch in thickness, although the thickness can vary, as desired, from one inch up to about 12 inches. The belt conveyor preferably is composed of stainless steel plates, although any standard steel can be used.

The admixture can be ignited by use of an acetylene torch, depicted schematically by numeral 3, although any source of ignition capable of exceeding approximately 1000° Centigrade can be used, as this is the approximate minimum temperature required to initiate reaction between the ore and the metallic aluminum. The temperature within the mass should not exceed approximately 1500° C in order to avoid melting any silica content present in the ore.

Suitable sources of ignition also include an ordinary match, a storm match (a match with an enlarged head having an increased proportion of potassium chlorate), and the use of a magnesium metal primer, as in the standard thermite process. Using an acetylene torch with a mass thickness of approximately 1 inch on the belt conveyor, the rate of ignition will be a steady rate of approximately 1 inch per minute. At this point, it should be mentioned that the rate of travel of the conveyor will, of course, be correlated with the ignition to provide substantially uniform and complete ignition of the admixture.

When the admixture is ignited, a portion of the powdered mass, due to the cooling effect of the metal surface, may not attain the ignition temperature. Consequently, a thin layer 4 of the powdered mass will form on the conveyor surface which will serve to protect the conveyor surface. Even though a small proportion of raw ore may thus be obtained in the final product, this does not affect adversely the successful operation of the process.

When the admixture of ore and metallic aluminum is ignited, a standard thermite type reaction occurs: $2Al+3MO=Al_2O_3+3M$, M representing the metal values of the ores. It is to be noted, however, that the present process is used with raw ore, that is no metal oxides need to be added to the ore, as in the standard thermite process. In addition to the thermite type reaction, when a sulfide ore is processed or one to which sulfur has been added, reaction will also occur between the metallic aluminum and the metallic sulfide as per the following equation: $2Al+3ms=Al_2S_3+3M$.

After the admixture of ore and metallic aluminum has been ignited, the temperature will increase to approximately 1500°C. whereby the admixture will be sintered and a coherent mass thus produced, as depicted by numeral 5 on the drawing. One advantage of this process is the formation of the sintered mass in a porous, easily pulverized form with substantially no loss of material by vaporization during ignition. The sintered mass thus contains many of the metals of the original ore in metallic form, as well as, of course, aluminum oxide and aluminum sulfide.

The sintered mass, which is still at a temperature of approximately 1500°C., is conveyed to a grinder 6 wherein it is ground to particle size of graded distribution of from 45 to −200 mesh. The mass exits from the grinder and descends by gravity past a series of electromagnets 7, 8, and 9. Magnet 7 is positioned with respect to grinder 6 such that the temperature of the mass has cooled to approximately 770°C. as the mass descends past the magnet. At this temperature, only the metallic cobalt in the ore is magnetic since its Curie point is approximately 1000°C. As the mass thus travels past the first electromagnet, the metallic cobalt is attracted to the magnet, separated therefrom, and collected in container 10. The mass next descends past the second electromagnet 8, which is spaced from magnet 7 a sufficient distance that the temperature of the mass will be slightly in excess of 358°C., which is the Curie point of nickel. Consequently, when the mass passes magnet 8, at a temperature, for example, within the range of from about 359° to about 475° C., metallic iron is separated therefrom and collected in container 11. As the mass proceeds past electromagnet 9, the temperature has decreased to within the range of approximately 100° to about 300° C. and consequently, metallic nickel is separated by magnetic attraction to electromagnet 9 and collected in container 12.

After the mass has traveled past electromagnet 9, the remaining portion of the mass, which includes additional metals produced by the above-described reactions, as well as aluminum oxide, aluminum sulfide, aluminum selenide, telluride and aresenide, is collected in container 15. This portion of the ore can be further processed to separate and recover the additional metal values.

At this point, it should be noted that the temperature of the mass during the aforesaid processing is at all times in excess of 100° C. to prevent the reaction of aluminum sulfide with water or water vapor whereupon aluminum hydroxide and hydrogen sulfide would be formed. The formation of hydrogen sulfide obviously is undesirable from the standpoint of atmospheric pollution, and accordingly, is to be avoided for that reason. By the same token, care must be taken to avoid such reaction after the metallic cobalt, iron and nickel values have been separated. To achieve this and at the same time to refine the remaining portion of the ore to recover the remaining metal values, such portion is removed from container 15 through door 16 and in one form of the process is ground as at 17 to a particle size of less than 200 mesh although grinding may be omitted if desired, and, preferably, subjected to elutriation in a stream of air with electrostatic control to minimize dust problems. The lighter materials consist mainly of aluminum compounds, small amounts of silica, and any sulfur, selenium or tellurium which are present. The heavier materials represent an increased concentration of metals, particularly the precious metals. The metal concentrate, as shown in the drawing, is subjected to the influence of an alternating current magnet 20 which repels the magnetic particles from the field. Such particles are collected in container 21 where they are available for further processing by standard methods to separate and recover the metals such as gold, platinum, silver, copper, and other precious metals which are present.

The non-conducting protion which is separated from the metal concentrate by the alternating current magnet will contain the aluminum sulfide referred to above. As indicated, because of the properties of this material, all preceding operations have been conducted at a temperature in excess of 100°C. The non-conductive portion is thus preferably collected in container 22 in an oxidizing solution, such as hypochlorite solution containing traces of cobalt as a catalyst, or other oxidants, such as nitric acid, potassium permanganate, etc. When the non-conductive portion is thus introduced into the oxidizing solution in container 22, the hydrogen sulfide which is generated by reaction between aluminum sulfide and water is oxidized to elemental sulfur and acids of sulfur, thereby preventing the objectionable effects of hydrogen sulfide.

Container 22 will contain aluminum in the form of soluble aluminum compounds such as aluminum arsenide, aluminum selenide, and aluminum telluride. Because acidic conditions have been developed in container 22 as described, the aluminum compounds can be further acidified to permit recovery by standard techniques.

The invention will be better understood by reference to the following specific but illustrative example.

EXAMPLE 364 grams of metallic aluminum powder was admixed with 2118 grams of powdered Trona ore containing major quantities of iron and silicon, aluminum and less than 2.0 percent by weight of each of the following elements: sodium, zinc, potassium, magnesium, copper, calcium, lead, titanium, manganese, chromium, barium, strontium, vanadium, silver, cobalt and nickel, as well as trace quantities of various other elements. The particle size of the admixture was approximately −200 mesh. The total weight of the mass prior to ignition was 2482 grams. The powder was then ignited utilizing an acetylene torch, and after ignition, the weight of the mass was 3215.1 grams, representing a gain of 733.1 grams. After ignition and sintering, which occurred at a temperature of approximately 1500°C., the sintered mass was ground, and the following amounts and distribution were obtained:

| | |
|---|---|
| 45 mesh | .2 grams |
| 80 mesh | 22.0 grams |
| 100 mesh | 519.8 grams |
| 200 mesh | 203.2 grams |
| −200 mesh | 607.7 grams |

The ground mass was then subjected to magnetic separation as described previously whereby the cobalt, iron and nickel contents were separated. The non-magnetic portion was thereafter subjected to the influence of an alternating current magnet whereby additional magnetic or metallic content was separated, leaving a final non-magnetic residue containing the aluminum compounds, non-metals, silica and other metal oxides. A total of 292.2 grams of magnetic residue was obtained, along with 104.0 grams of non-magnetic residue.

The non-magnetic residue was treated with 1000 ml. of concentrated hydrochloric acid and evaporated to dryness. After drying, the weight was 163.3 grams, thus representing a gain in weight of 59.6 grams. The non-magnetic portion was thereafter placed in plastic bottle and treated with 200 ml. of hydrofluoric acid to apparent evolution of all silica. The residue was thereafter washed and treated to remove the selenium, germanium, arsenic, osmium and ruthenium. A precipitate was also produced containing tungsten, tantalum, and gold.

The liquid portion was thereafter separated from the precipitate utilizing a centrifuge. The decanted liquid was a green color, indicating the presence of copper, which was found to be about 3.5 percent.

The precipitate was washed with water and dried in a weighed nickel crucible, the weight of the precipitate being about 32.355 grams. The precipitate was thereafter treated in a solution of sulfuric acid to remove the remaining aluminum, which may be reused in the recovery process. The precipitate was found to be about 1.5 percent of the original weight of the ore.

It will be appreciated from the foregoing description that the present invention represents an effective process for separating and recovering metals from sulfide and oxide containing ores utilizing metallic aluminum as a reducing agent. In this regard, it is also to be noted that such process permits the ore to be sintered continuously utilizing extremely simple equipment. It is likewise to be noted that sintering at a temperature below about 1500°C. precludes formation of alloys of iron, copper, and nickel, which would pose substantial problems in magnetic separation since these alloys are magnetic only when subjected to special heat treatments.

Although the working example illustrates the invention with a specific ore, it is to be understood that other ores may be used with equally satisfactory results, including ores contain major quantities of aluminum, silicon and sulfur as well as substantial quantities of iron, copper and potassium. For brevity of disclosure, however, examples using such ores will not be set forth herein.

The present invention also represents further significant advantage in that the silica content of the ore, when the ore is processed as described herein, fuses with the iron and thus is separated with the iron in the magnetic concentration step. This is in decided contrast to a typical smelting operation in which ore is subjected to extremely high temperatures whereby the metal melts and the silicates are removed in the form of a slag. Silica removal is thus achieved in this invention without formation of a slag and the problems resulting therefrom.

Although the present invention has been described with reference to magnetic separation of the iron, cobalt and nickel values, in certain instances, it may be desirable to utilize other methods of separation such as electrostatic separation or a magnetic field. In view of the relative simplicity of the process as described, however, it is generally preferred to utilize magnetic separation.

Since the reaction between the metallic aluminum, or aluminum and sulfide, and the ore is exothermic, it proceeds without further ignition or assistance once ignited. Consequently, elaborate heating equipment is unnecessary and the entire process may be performed at the mine site. In view of the relatively simple equipment which is thus needed, the equipment may be mounted on a platform for movement from one mine location to another, which is a distinct advantage.

I claim:

1. A process for recovering the metal content of metal containing ores selected from the group consisting of sulfide and oxide ores and mixtures and concentrates thereof comprising igniting an intimately admixed mass consisting essentially of said ore and metallic aluminum to cause the metal content thereof to be converted to metallic form, sintering said ignited mass at a temperature within the range of approximately 1000° to 1500° C. to form a coherent, porous and easily pulverizable mass containing the metal content of said ore in metallic form, and subsequently separating and recovering the metal content therefrom.

2. The process of claim 1 in which said sintered mass is ground prior to said separation and recovery.

3. The process of claim 2 in which said sintered mass is ground to a graded distribution of from 45 to −200 mesh.

4. The process of claim 2 in which said ore contains a magnetic and non-magnetic metal content and said magnetic metal content is separated from said sintered and ground mass by magnetic separation.

5. The process of claim 4 in which said ore contains sulfur and/or silica compounds of cobalt, iron and nickel, and in which said sintered and ground mass is cooled to a temperature within the range of from approximately 770°C. to approximately 1000°C. and conveyed past a first electromagnet whereby said metallic cobalt content of said ore is separated by said electromagnet, cooled to a temperature no lower than approximately 359°C. and conveyed past a second electromagnet whereby said metallic iron content of said ore is separated by said electromagnet, and subsequently cooled to a temperature no lower than approximately 100°C. and conveyed past a third electromagnet whereby said metallic nickel content is separated therefrom.

6. The process of claim 4 in which the temperature of said ore during magnetic separation is at all times maintained at a temperature in excess of 100°C. to prevent the reaction of aluminum sulfide with water.

7. The process of claim 1 in which said ore is a sulfide containing ore selected from the group consisting of pyrites, pyrrhotites, galena, chalco-pyrite, decomposed pyrite ores and arseno pyrites.

8. The process of claim 1 in which said mass is ignited on a conveyor and a protective layer of said ore is formed on the surface of said conveyor.

9. The process of claim 4 in which the non-magnetic portion of said ore is further processed to recover additional metal values.

10. The process of claim 9 in which said non-magnetic portion is ground to a particle size of −200 mesh and subsequently subjected to the influence of an alternating current magnet to separate additional metal content from said ore.

11. The process of claim 10 in which the portion of said ore, non-conductive to said alternating current magnet, is collected in an oxidizing solution to prevent the reaction between aluminum sulfide and water.

12. The process of claim 11 in which said oxidizing solution is a hypochlorite solution containing a cobalt catalyst.

13. The process of claim 11 in which said non-conductive portion of said ore is subsequently treated to recover aluminum compounds therefrom.

14. The process of claim 9 in which said non-magnetic portion is subsequently treated with hydrochloric and hydrofluoric acid to remove the silica content and thereafter is washed and further processed to remove additional metals therefrom.

15. The process of claim 13 in which aluminum is subsequently recovered for further use in said process.

16. A process for recovering the metal content of ores selected from the group consisting of metal containing sulfide and oxide ores and mixtures and concentrates thereof comprising igniting a mass consisting essentially of an intimate admixture of said ore and metallic aluminum to cause the metal content of said ore to be converted to metallic form, sintering said ignited mass at a temperature within the range of approximately 1000° to about 1500° C. to form a coherent, porous and easily pulverizable mass containing the metal content of said ore in metallic form, grinding said sintered mass, cooling said mass to a temperature within the range of from approximately 770° to approximately 1000° C., and conveying the same past a first electromagnet whereby the metallic cobalt content thereof is separated therefrom, further cooling said mass to a temperature no lower than approximately 359° C. and conveying the same past a second electromagnet to separate the metallic iron content therefrom, and subsequently cooling said mass to a temperature no lower than approximately 100° C. and conveying the same past a third electromagnet to separate the metallic nickel content therefrom.

17. The process of claim 16 in which said ore is a sulfide containing ore selected from the group consisting of pyrites, tyrrhotites, galena, chalco-pyrite, decomposed pyrite ores and arseno pyrites.

* * * * *